US010593192B1

(12) United States Patent
Tillotson

(10) Patent No.: US 10,593,192 B1
(45) Date of Patent: Mar. 17, 2020

(54) SMOKE DETECTOR HAVING A MAGNET

(71) Applicant: The Boeing Company, Chicago, IL (US)

(72) Inventor: Brian Tillotson, Seattle, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 16/194,656

(22) Filed: Nov. 19, 2018

(51) Int. Cl.
*G08B 29/14* (2006.01)
*G08B 17/113* (2006.01)

(52) U.S. Cl.
CPC ..... *G08B 29/145* (2013.01); *G08B 17/113* (2013.01)

(58) Field of Classification Search
CPC ..... G01N 27/66; G01T 7/125; G08B 17/113
See application file for complete search history.

(56) References Cited

U.S. PATENT DOCUMENTS 3,913,082 A 10/1975 Hamm
4,456,907 A 6/1984 Johnson

OTHER PUBLICATIONS

Non-Final Office Action issued in co-pending U.S. Appl. No. 15/599,566, U.S. Patent and Trademark Office, dated Jul. 25, 2018, 14 pages.

*Primary Examiner* — Omeed Alizada
(74) *Attorney, Agent, or Firm* — McDonnell Boehnen Hulbert & Berghoff LLP

(57) ABSTRACT

An example smoke detector includes (i) a chamber, wherein gas is disposed in an inner space of the chamber; (ii) an electrode disposed within the chamber; (iii) a magnet configured to generate a magnetic field in the inner space of the chamber; and (iv) a radioactive source generating alpha particles within the inner space of the chamber.

20 Claims, 9 Drawing Sheets

SMOKE DETECTOR HAVING A MAGNET

FIELD

The present disclosure relates generally to smoke detectors.

BACKGROUND

A smoke detector is a device that senses the presence of smoke, typically as an indicator of fire. Commercial security devices issue a signal to a fire alarm control panel as part of a fire alarm system, while household smoke detectors, also known as smoke alarms, generally issue a local audible or visual alarm from the detector itself.

Smoke detectors may be housed in plastic enclosures, typically shaped like a disk about 150 millimeters (6 in) in diameter and 25 millimeters (1 in) thick, but shape and size can vary. Smoke can be detected either optically (photoelectric) or by physical process (ionization), Detectors may use either, or both, methods.

Smoke detectors in large commercial, industrial, and residential buildings are usually powered by a central fire alarm system, which is powered by the building power with a battery backup. Domestic smoke detectors range from individual battery-powered units, to several interlinked mains-powered units with battery backup; if any unit detects smoke, all trigger even in the absence of electricity.

An ionization smoke detector uses a radioisotope to ionize air or any other gas within a chamber, and an electric current is generated via the ions created within the chamber. If smoke enters the chambers, the electric current changes. A difference in the electric current is detected and an alarm is generated.

The radioisotope in ionizing smoke detectors may pose a potential environmental hazard, if the smoke detector is damaged (e.g., in a fire), thus causing the radioisotope to be exposed. Exposure of radioactive material to the environment may pose environmental and health risks. It may thus be desirable to have systems, apparatuses, and smoke detectors that use a reduced amount of radioactive material, yet have enhanced efficiency to maintain sensitivity to smoke. This way, the environmental risk may be reduced.

SUMMARY

The present disclosure describes embodiments that relate to a smoke detector having a magnet.

In one aspect, the present disclosure describes a smoke detector. The smoke detector includes: (i) a chamber; (ii) a first electrode disposed within the chamber; (iii) a magnet disposed within the chamber opposite the first electrode, wherein the magnet is electrically-conductive and is configured as a second electrode, wherein gas is disposed in an inner space of the chamber between the first electrode and the magnet, and wherein the magnet is configured to generate a magnetic field in the inner space of the chamber; and (iv) a radioactive source generating alpha particles within the inner space of the chamber.

In another aspect, the present disclosure describes another smoke detector. The smoke detector includes: (i) a chamber; (ii) a first electrode disposed within the chamber; (iii) a second electrode disposed within the chamber opposite the first electrode, wherein gas is disposed within the chamber between the first electrode and the second electrode; (iv) a radioactive source mounted to the first electrode, wherein the radioactive source is configured to emit alpha particles in the gas disposed between the first electrode and the second electrode; and (v) a magnet disposed in the smoke detector and coupled to an exterior surface of the chamber adjacent to the second electrode, wherein the magnet generates a magnetic field having magnetic flux lines passing through the gas between the first electrode and the second electrode.

In still another aspect, the present disclosure describes another smoke detector. The smoke detector includes: (i) a chamber; (ii) a first electrode disposed within the chamber; (iii) a second electrode disposed within the chamber, wherein gas is disposed in an inner space of the chamber between the first electrode and the second electrode; (iv) a radioactive source emitting alpha particles in the gas disposed between the first electrode and the second electrode; (v) a first magnet that is ring-shaped and mounted to an exterior surface of the chamber at a first side of the chamber; and (vi) a second magnet that is ring-shaped and mounted to the exterior surface of the chamber at a second side of the chamber opposite the first side thereof, wherein the first magnet and the second magnet cooperate to generate a magnetic field having magnetic flux lines passing through the gas disposed between the first electrode and the second electrode.

The foregoing summary is illustrative only and is not intended to be in any way limiting. In addition to the illustrative aspects, embodiments, and features described above, further aspects, embodiments, and features will become apparent by reference to the figures and the following detailed description.

BRIEF DESCRIPTION OF THE FIGURES

The novel features believed characteristic of the illustrative embodiments are set forth in the appended claims. The illustrative embodiments, however, as well as a preferred mode of use, further objectives and descriptions thereof, will best be understood by reference to the following detailed description of an illustrative embodiment of the present disclosure when read in conjunction with the accompanying Figures.

DETAILED DESCRIPTION

Figure 1:
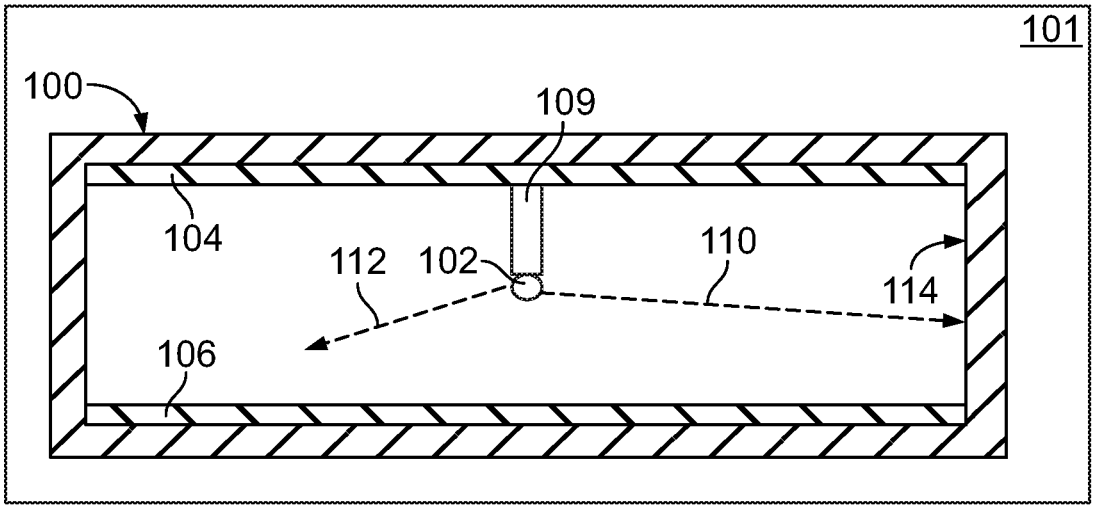
FIG. 1 illustrates a cross section of an ionization chamber of a smoke detector, in accordance with an example implementation.
Figure 2:
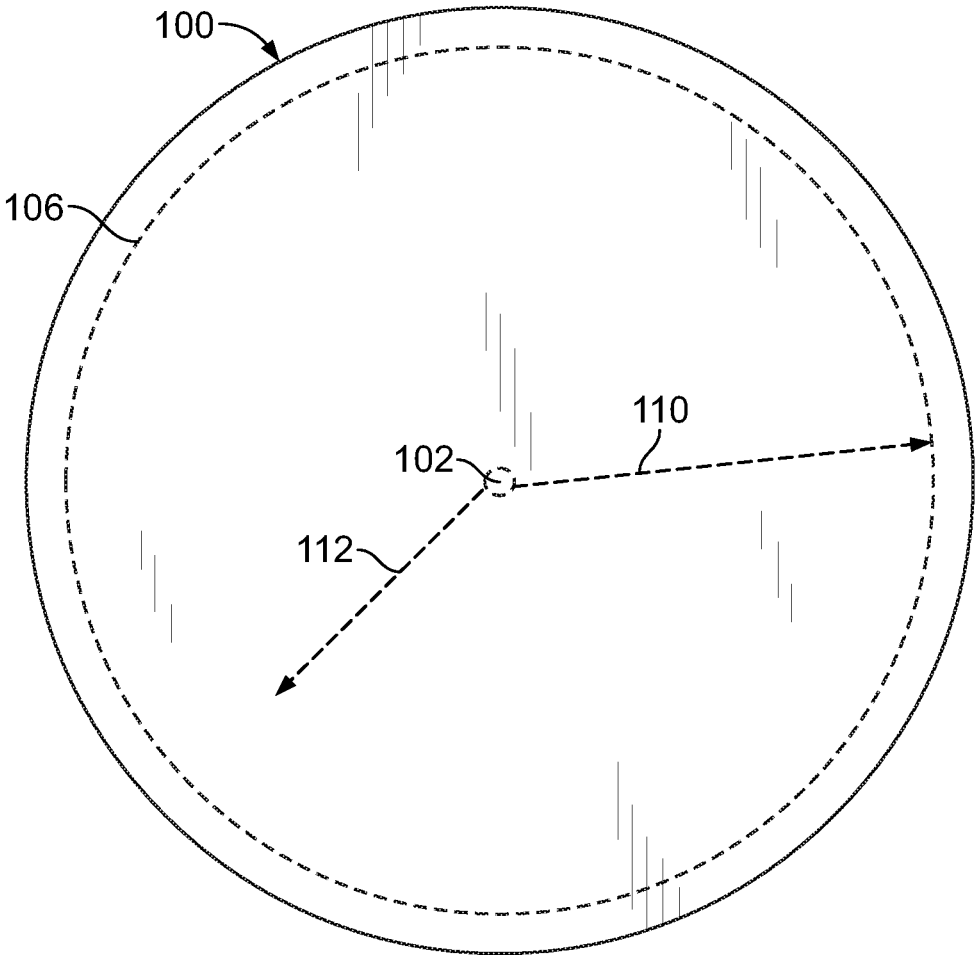
FIG. 2 illustrates a bottom view of the ionization chamber shown in FIG. 1, in accordance with an example implementation.

FIG. 1 illustrates a cross section of an ionization chamber 100 of a smoke detector 101, and FIG. 2 illustrates a bottom view of the ionization chamber 100, in accordance with an example implementation. The smoke detector 101 is not shown in FIG. 2 to reduce visual clutter in the drawing.

In examples, the ionization chamber 100 may have a cylindrical shape. However, other shapes are possible. The ionization chamber 100 includes a radioactive source 102 that emits alpha particles in an inner space of the ionization chamber 100. As an example, the radioactive source 102 may include a radioisotope such as americium-241 configured to emit alpha particles within the ionization chamber 100. For instance, the radioactive source 102 may include a small amount of americium-241, e.g., 0.29 microgram (μg). The radioactive element americium has a half-life of 432 years, and is a source of alpha particles with a kinetic energy of about 5 million electron-volts (MeV).

The ionization chamber 100 also includes a first electrode 104 and a second electrode 106. A battery or some other power source can be used to create a voltage or potential difference between the electrode 104 and the electrode 106. As a result, one of the electrodes, e.g., the electrode 104, can have a positive voltage, whereas the other electrode, e.g., the electrode 106, can have a negative voltage.

As shown in FIG. 2, if the ionization chamber 100 is shaped as a cylinder, the electrodes 104 and 106 can be shaped as disks disposed within the ionization chamber 100. In this example where the ionization chamber 100 is cylindrically-shaped, the first electrode 104 can be disposed at or mounted to an interior surface of a first base of the ionization chamber 100, whereas the second electrode 106 can be disposed at or mounted to an interior surface of a second base opposite the first base of the ionization chamber 100.

The alpha particles generated by the radioactive source 102 in the inner space of the ionization chamber 100 ionize the oxygen and nitrogen atoms of the air or other gas disposed between the electrodes 104 and 106. Ionization of an oxygen or nitrogen atom "knocks" an electron off of the atom. As a result, a free electron (with a negative charge) is generated and the atom is left missing one electron, and therefore the atom turns into an ion having a positive charge. The negative electron is attracted to the electrode with a positive voltage (e.g., the electrode 104), and the positively charged ion is attracted to the electrode a negative voltage (e.g., the electrode 106), and an electric current is thus generated.

The smoke detector 101 can include an electronic circuit that detects the small amount of electrical current that the movement of the electrons and ions toward the electrodes 104 and 106 generates. The ionization chamber 100 is not sealed and is configured to allow smoke to enter therein. When smoke enters the ionization chamber 100, the smoke disrupts the electric current. Particularly, the smoke particles attach to the ions and neutralize them, and therefore the ions would not be available to carry the electric current in the ionization chamber 100.

The electronic circuit of the smoke detector 101 can thus sense a drop in electric current between the electrodes 104 and 106 and sets off an alarm. For example, the smoke detector 101 may include a second chamber (not shown) therein. The second chamber may be similar to the ionization chamber 100, but is sealed and operates as a reference chamber. The radioactive source 102 or a similar source can also emit alpha particles within the second chamber, which can include electrodes similar to the electrodes 104 and 106, and thus an electric current is generated therein as well. Because the second chamber is sealed, smoke might not enter therein, and the electric current in the second chamber would not be disrupted or dropped as a result of smoke. The electronic circuit of the smoke detector 101 can detect, e.g., via a comparator, a difference in the electric current of the ionization chamber 100 and the respective electric current of the second chamber, and accordingly sounds an alarm.

In another example, the smoke detector 101 can include a Metal Oxide Semiconductor Field Effect Transistor (MOSFET). The battery of the smoke detector 101 can bias the gate of the MOSFET so as to generate an electric current through the MOSFET. However, the electric current generated as a result of ionization of air molecules within the ionization chamber 100, opposes and cancels the electric current from the battery through the MOSFET. If smoke enters the ionization chamber 100, the electric current generated via the ions therein is disrupted and does not cancel the electric current from the battery. As a result, electric current flows through the MOSFET, thereby triggering an alarm.

The amount of radioactive material in the radioactive source 102 (e.g., 0.29 μg of americium 241) is an amount configured or selected to provide sufficient ionization electric current to detect smoke, while producing a low level of radiation outside the smoke detector 101. However, the radioactive material might pose a potential environmental hazard when the smoke detector 101 is disposed of, or if the smoke detector 101 is damaged and the radioactive material is exposed. Therefore, it may be desirable to reduce the amount of radioactive material used in the radioactive source 102. Disclosed herein are systems, apparatuses, ionization chambers, and smoke detectors that achieve an enhanced efficiency of ionization within the ionization chamber 100 so as to provide the same smoke detection ability and safety level, while using a reduced amount of radioactive material.

As mentioned above, the radioactive source 102 is chosen to emit alpha particles. Alpha particles are used as opposed to beta (electron) and gamma (electromagnetic) radiation because alpha particles have high ionization rates. As such, sufficient air particles will be ionized and a detectable electric current is generated. Further, alpha particles have low penetrative power. Thus, many alpha particles might be stopped by the plastic of a body or container of the smoke detector 101. However, some alpha particles might escape the smoke detector 101.

In examples, the radioactive material in the radioactive source 102 may be configured as thin layers or tiny particles. This configuration may ensure that the radioactive material absorbs or slows relatively few alpha particles emitted from within the radioactive material.

Further, in examples, the radioactive source 102 can be positioned at the center of the ionization chamber 100 between the electrodes 104 and 106. For instance, the radioactive source 102 can be mounted to a post or pole 109. As an example, the radioactive source 102 can be coupled to a tip of the pole 109. The pole 109 protrudes from the electrode 104 or 106 within the inner space of the ionization chamber 100 so as to position the radioactive source 102 proximate to, or substantially at, a center of the ionization chamber 100. The term "substantially at the center" or "proximate to the center" indicates that the radioactive source 102 is placed within a threshold distance, such as 5 millimeter (mm), from the center of the ionization chamber 100. With this configuration, an alpha particle emitted in any direction between the electrodes 104 and 106 ionizes air molecules disposed therebetween. However, in other examples, the radioactive source 102 might be positioned closer to or on one of the electrodes 104, 106 as described below with respect to FIG. 7.

As depicted schematically in FIGS. 1 and 2, when alpha particles are emitted, they may traverse straight line paths such as straight paths 110 and 112. Due to geometry of the ionization chamber 100 and the geometry of the radioactive source 102, some particles can travel longer paths compared to other particles. For example, a particle emitted from deeper within the chunk of radioactive material of the radioactive source 102 can lose more energy before it exits the radioactive source 102 than one emitted from close to the surface of the radioactive source 102. The alpha particle emitted from deeper inside therefore travels less distance in air before stopping, even if it does not encounter an electrode or chamber wall. Regarding the geometry of the ionization chamber 100, for example, some alpha particles can traverse a longer path, e.g., the straight path 110, between the radioactive source 102 and an interior peripheral side surface 114 of the ionization chamber 100. Other alpha particles can traverse a shorter path, e.g., the path 112, between the radioactive source 102 and the electrodes 104, 106.

Alpha particles traversing longer paths within the ionization chamber 100 can be more effective in ionizing air particles than alpha particles traversing a shorter path because particles traversing through the longer paths spend more time expending their energy within the ionization chamber 100. Once an alpha particle reaches the interior peripheral side surface 114 of the ionization chamber 100 or one of the electrodes 104, 106, the alpha particle can impart its remaining energy to molecules of the interior peripheral side surface 114 or the electrodes 104, 106. Such imparted energy is wasted as it is not used to ionize air molecules in the ionization chamber 100. Thus, the energy spent within the ionization chamber 100 is used to ionize the air particles therein, while the energy spent at the interior peripheral side surface 114 or electrodes 104, 106 is wasted.

Further, an alpha particle is characterized in that, as it travels through the air within the ionization chamber 100, the energy lost by the alpha particle and used to ionize air molecules is inversely proportional to the square of its velocity. Thus, a peak of energy loss can occur just before the alpha particle comes to a complete stop. This peak is referred to as the Bragg peak.

Figure 3:
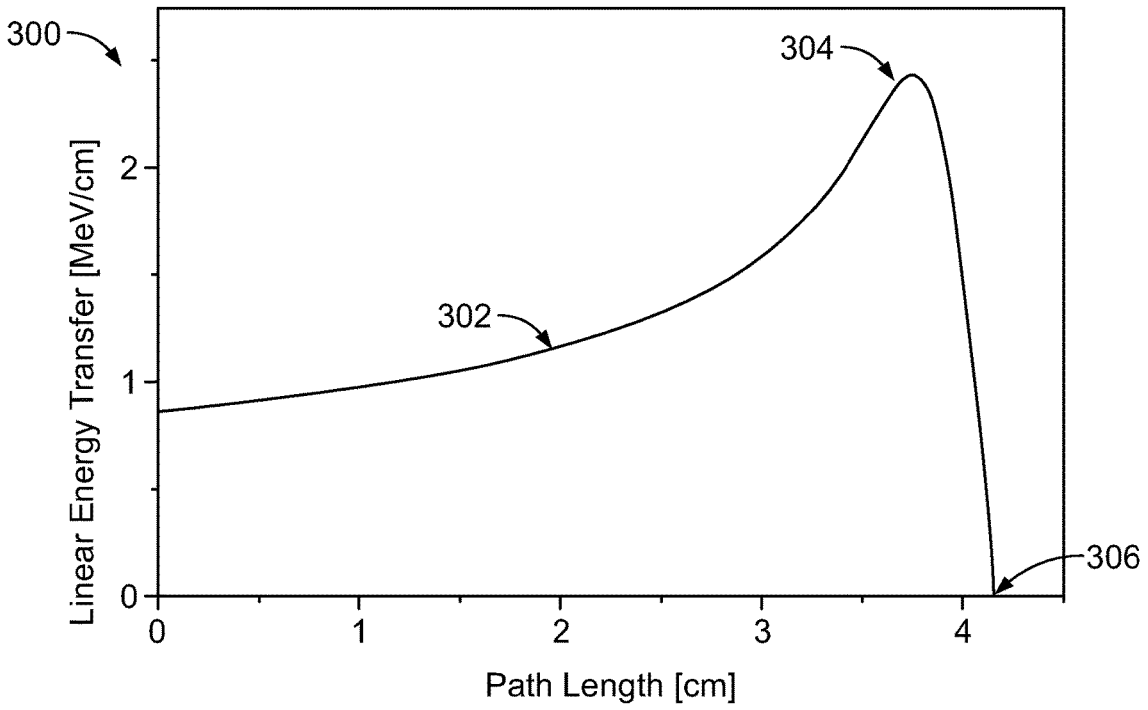
FIG. 3 illustrates a graph showing variation of linear energy transfer of an alpha particle as the alpha particle travels through air, in accordance with an example implementation.

FIG. 3 illustrates a graph 300 showing variation of linear energy transfer of an alpha particle as the alpha particle travels through air, in accordance with an example implementation. The vertical axis of the graph 300 represents the linear energy transfer, which is the kinetic energy imparted from the alpha particle to air molecules, mostly by ionization, in Million electron-volt per centimeter traveled (MeV/cm). The horizontal axis represents path length of the alpha particle in (cm). Curve 302 of the graph 300 can be referred to as the Bragg curve and illustrates the variation of the linear energy transfer of the alpha particle with path length.

A peak 304 of the curve 302 occurs before the alpha particle stops at point 306. Thus, the majority of the energy of the alpha particle is spent right before its stops. As such, most of the energy of the alpha particle can be spent when, or right before, it impacts the interior peripheral side surface 114 or the electrode 104, 106 within the ionization chamber 100. With this configuration, a large amount of the energy of the alpha particles might be wasted, and not utilized to ionize air molecules.

In some examples, some alpha particles may escape the ionization chamber 100. If an alpha particle escapes the ionization chamber 100 with 10% of its path length before stoppage still remaining, then due to the shape of the curve 302, as much as 40% of the ions created by the alpha particle would be generated outside the ionization chamber 100.

As a result, in conventional smoke detectors, the radioactive material of the radioactive source 102 is sized while taking into consideration that in many cases most of the energy of the alpha particles is wasted and not used to ionize the air within the ionization chamber 100. As described herein, if the alpha particles are forced to stay longer or stop within the ionization chamber 100 before impacting the interior peripheral side surface 114 or the electrode 104, 106, then most of the energy of the alpha particles would be used to ionize air molecules within the ionization chamber 100. In this case, efficiency of the smoke detector may be enhanced, and thus less radioactive material might be used to achieve the same smoke detection capability of conventional smoke detectors. Also, in some cases, a smaller ionization chamber 100 can be used to achieve the same smoke detection capability.

Figure 4:
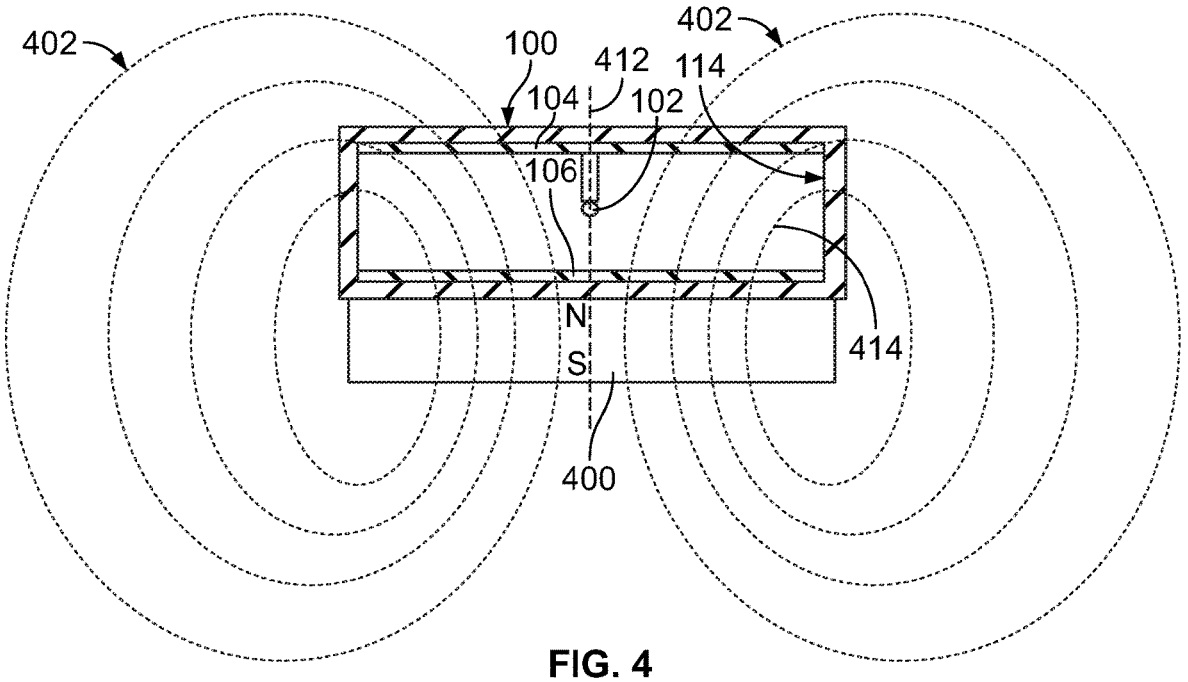
FIG. 4 illustrates a magnet coupled to an ionization chamber, in accordance with an example implementation.

FIG. 4 illustrates a magnet 400 coupled to the ionization chamber 100, in accordance with an example implementation. In examples, the magnet 400 can be coupled or mounted within the smoke detector 101 to an exterior surface of the ionization chamber 100. For example, if the ionization chamber 100 is cylindrical, the magnet 400 can be coupled to an exterior surface of one of the bases of the ionization chamber 100. As shown in FIG. 4, the magnet 400 can be coupled, for example, to a base of the ionization chamber 100 that is adjacent to the electrode 106. However, in other examples, the magnet 400 can be coupled to the ionization chamber 100 adjacent to the electrode 104.

In examples, the magnet 400 can be disposed parallel to the electrode 106. However, in other examples, the magnet might not be parallel to the electrode 104 or 106. Further, the magnet 400 is disposed within the smoke detector 101, which is not shown in FIG. 4 to reduce visual clutter in the drawing.

The magnet 400 generates a magnetic field 402 having magnetic flux lines passing through the air within the ionization chamber 100. Because the alpha particles emitted by the radioactive source 102 are positively charged, the magnetic field 402 causes paths of the alpha particles to curve within the ionization chamber 100.

Figure 5:
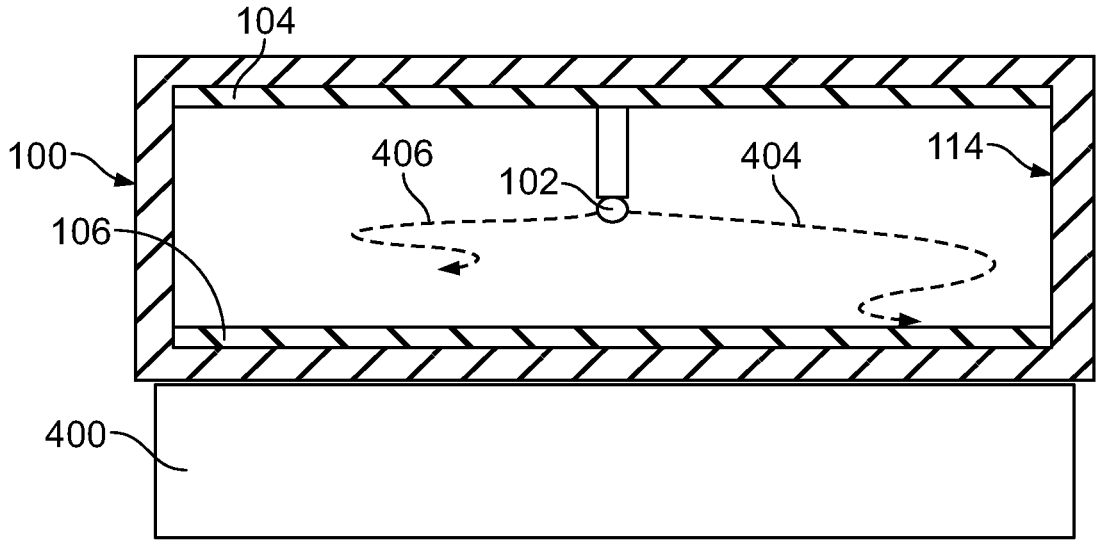
FIG. 5 illustrates a cross section of an ionization chamber schematically showing curved paths of alpha particles, in accordance with an example implementation.
Figure 6:
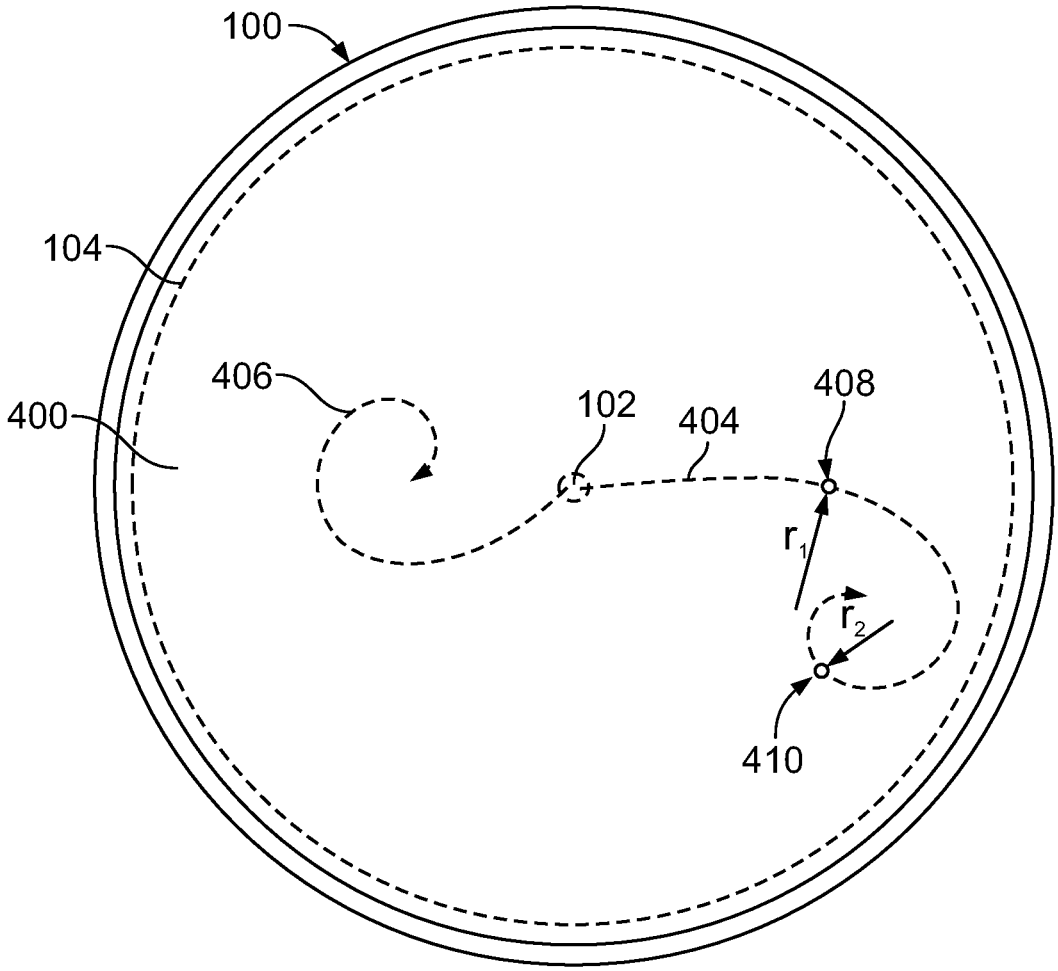
FIG. 6 illustrates a bottom view of an ionization chamber schematically showing curved paths of alpha particles, in accordance with an example implementation.

FIG. 5 illustrates a cross-sectional view of the ionization chamber 100 schematically showing curved paths of alpha particles, and FIG. 6 illustrates a bottom view of the ionization chamber 100 schematically showing curved paths of alpha particles, in accordance with an example implementation. Rather than traveling in the straight paths 110 and 112 toward the interior peripheral side surface 114 or the electrodes 104, 106 as shown in FIG. 1, the alpha particles follow curved paths such as curved paths 404 and 406 as a result of the magnetic field 402.

Because an alpha particle traverses a curved path between two points rather than a straight line, the alpha particle travels a longer distance within the ionization chamber 100 due to the presence of the magnetic field 402. As a result of the curvature of the path traversed by an alpha particle, the alpha particle spends more time within the ionization chamber 100 and imparts more energy to the air molecules therein, thus ionizing more air molecules.

The extent of curvature of the curved paths 404, 406 at a particular point can be characterized by the magnitude of "curvature" at the particular point or by the radius of curvature, which is the inverse of "curvature." The radius of curvature at a particular point along the curved path 404, 406 is estimated as the radius of a circular arc, which approximates the curved path at the particular point.

In an example, the radius "r" of curvature at a particular point of the curved path 404, 406 (or any other curved path) traversed by an alpha particle can be determined using the following equation:

$$r = \frac{1}{B}\sqrt{\frac{2\ \mathrm{mV}}{q}} \tag{1}$$

where B is the magnetic field strength, m is the mass of the alpha particle, V is the voltage applied to accelerate the alpha particle from a standstill to its present kinetic energy, and q is the charge of the alpha particle. As an example for illustration, if B is 1.2 Tesla (achievable with the magnet 400 being for example mad of Neodymium rare-earth material), m is $6.62\times10^{-27}$ kilogram (mass of the alpha particle), V is $1.5\times10^{6}$ volts (voltage corresponding to kinetic energy of an alpha particle partly slowed from initially having 5 MeV energy and not yet slowed to the Bragg peak), then r can be calculated using equation (1) to be about 0.21 meters.

The curvature of the curved paths 404, 406 increases, and thus the radius of curvature decreases, as the alpha particle is slowed by air in the ionization chamber 100, i.e., as the alpha particle travels farther from the radioactive source 102. As an example for illustration, radius of curvature "$r_1$" of a point 408 along the curved path 404 is larger than a respective radius of curvature "$r_2$" of a point 410 that is traversed subsequent to traversal of the point 408 along the curved path 404 by an alpha particle. Because curvature is the inverse of the radius of curvature, then curvature at the point 410 is larger than curvature at the point 408. Thus, the farther the alpha particle travels along a particular path, the larger the path curvature, thereby giving the alpha particle more time within the ionization chamber 100 to impart energy to, and ionize, air molecules.

The magnetic field 402 can thus increase the amount of air that the alpha particle passes through as the alpha particle travels within the ionization chamber 100 from the radioactive source 102 toward the interior peripheral side surface 114 or the electrodes 104, 106. If the alpha particle escapes the ionization chamber 100, the alpha particle would have created more ions therein compared to the configuration of a smoke detector without a magnet.

Further, many alpha particles might not leave the ionization chamber 100. Rather, they may traverse a spiral path while still within the ionization chamber 100, thereby expending all their kinetic energy to create air ions. As such, the peak 304 shown in FIG. 3 occurs while the alpha particles are still within the ionization chamber 100, as opposed to just before or upon impacting the interior peripheral side surface 114 or one of the electrodes 104, 106.

Due to the alpha particle spending more time traversing a curved path (e.g., the curved paths 404, 406) within the ionization chamber 100 and possibly stopping therein, an increased amount of energy of the alpha particle is spent ionization air molecules. The efficiency of the smoke detector 101, which can be measured as the amount of ionized air molecules for a given amount of radioactive material in the radioactive source 102, can thus increase. As a result of the increased efficiency, a smaller amount of radioactive material can be used to generate a given amount of ions within the ionization chamber 100.

Additionally, the size of the ionization chamber 100 can be decreased. In the configuration of FIG. 1 the alpha particle travels a certain straight line distance from the radioactive source 102 to the interior peripheral side surface 114 of the ionization chamber 100 to ionize a given amount of air molecules. However, with the magnetic field 402 present in the configuration of FIGS. 4-6, the alpha particle can ionize the given mount of air molecules while traversing a smaller distance from the radioactive source 102 to the interior peripheral side surface 114 of the ionization chamber 100 due to the curvature of the path it traverses. Thus, the diameter or size of the ionization chamber 100 can be reduced, while maintaining the effectiveness and sensitivity of the smoke detector 101.

In examples, the electrodes 104, 106 can be made of aluminum or non-ferromagnetic stainless steel material. In other example implementations, however, the electrodes 104, 106 can be made of a ferromagnetic material, rather than aluminum or non-ferromagnetic stainless steel material. If the electrodes 104, 106 are made of a ferromagnetic material, more magnetic flux lines of the magnetic field 402 can be channeled into the ionization chamber 100, thereby reducing the amount of radioactive material of the radioactive source 102 that is sufficient to operate the smoke detector 101 at a sensitivity level comparable to existing smoke detectors.

Magnets are generally made of a group of metals called the ferromagnetic metals, such as nickel and iron. Such ferromagnetic metals are electrically-conductive. As such, magnets can also operate as electrodes that can be coupled to a voltage source and voltages can be applied thereto to generate a potential difference. Thus, in some example implementations, the magnet 400 can be configured to introduce the magnetic field 402 within the ionization chamber 100, while also operating as an electrode, thereby replacing one of the electrodes 104, 106.

Figure 7:
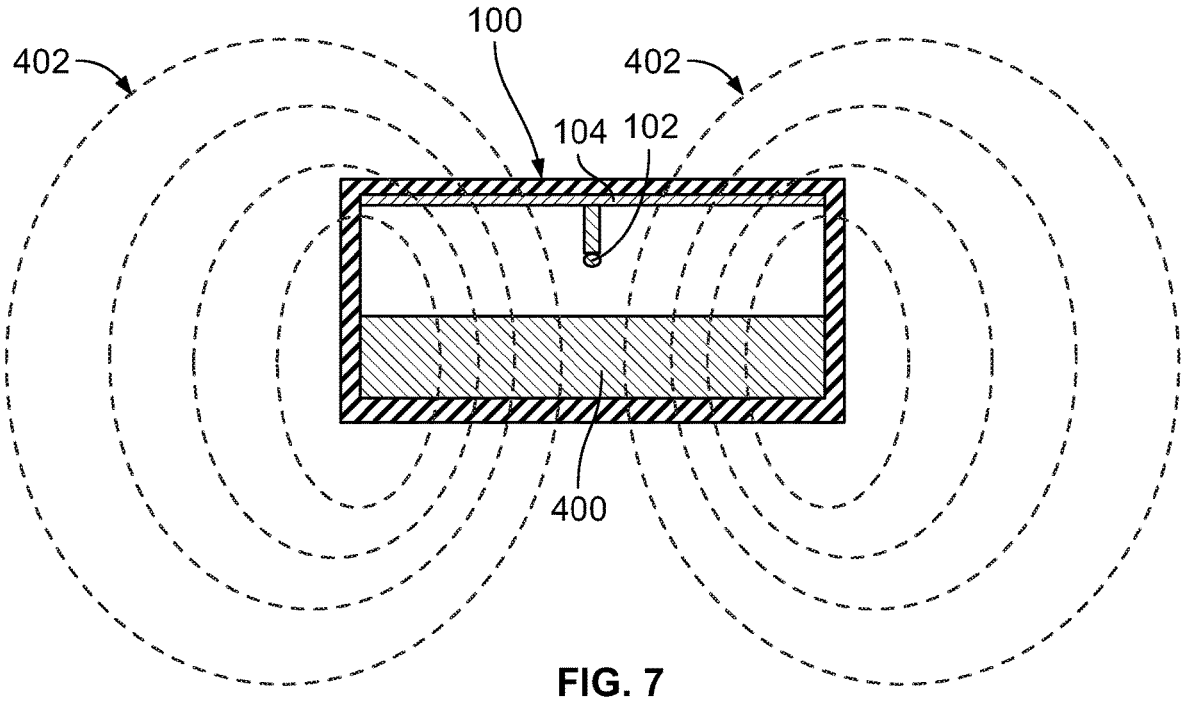
FIG. 7 illustrates a magnet being disposed within an ionization chamber, in accordance with an example implementation.

FIG. 7 illustrates the magnet 400 being disposed within the ionization chamber 100, in accordance with an example implementation. While in the configuration of FIG. 4 the magnet 400 is coupled to an exterior surface of the ionization chamber 100, in the configuration of FIG. 7 the magnet is mounted within the ionization chamber 100 to an interior surface of the ionization chamber 100 opposite the electrode 104. Further, as shown in FIG. 7, the electrode 106 is eliminated and the magnet 400 is configured to operate as the second electrode that cooperates with the electrode 104 to generate an electric current.

With the configuration of FIG. 7, the magnet 400 is configured to both generate the magnetic field 402 within the ionization chamber 100 and operate as an electrode. This way, cost of the smoke detector 101 can be reduced by eliminating the cost of the second electrode 106.

Also, assembly of the smoke detector 101 during manufacturing thereof is simplified. Particularly, an assembly step associated with placing the second electrode 106 in the ionization chamber 100 during assembly of the smoke detector 101 is eliminated. Thus, manufacturing time and cost may be reduced.

Further, the magnet 400 is spatially closer to the air within the ionization chamber 100, and therefore more magnetic flux lines of the magnetic field 402 can be introduced within the ionization chamber 100 per unit mass of the magnet 400 compared to the configuration of FIG. 4. This way, the magnetic field 402 can be rendered more effective in causing the alpha particles to ionize a larger number of ions. In examples, because the magnet 400 occupies a particular volume within the ionization chamber 100 in the configuration of FIG. 7, the size of the ionization chamber 100 can be increased compared to the configuration of FIG. 4 so as to maintain the volume of air within the ionization chamber 100.

Referring back to FIG. 4, in examples, the magnetic field 402 can be more effective when alpha particles travel in a path that is perpendicular to the magnetic flux lines rather than parallel thereto. Magnetic field lines of the magnetic field 402 as illustrated in FIG. 4 are oval-shaped. Due to the oval shape of the magnetic flux lines, when the radioactive source 102 is placed at, or substantially at, the center of the ionization chamber, more alpha particles may travel substantially parallel to, or at an acute angle relative to, the magnetic flux lines rather than perpendicular thereto.

Figure 8:
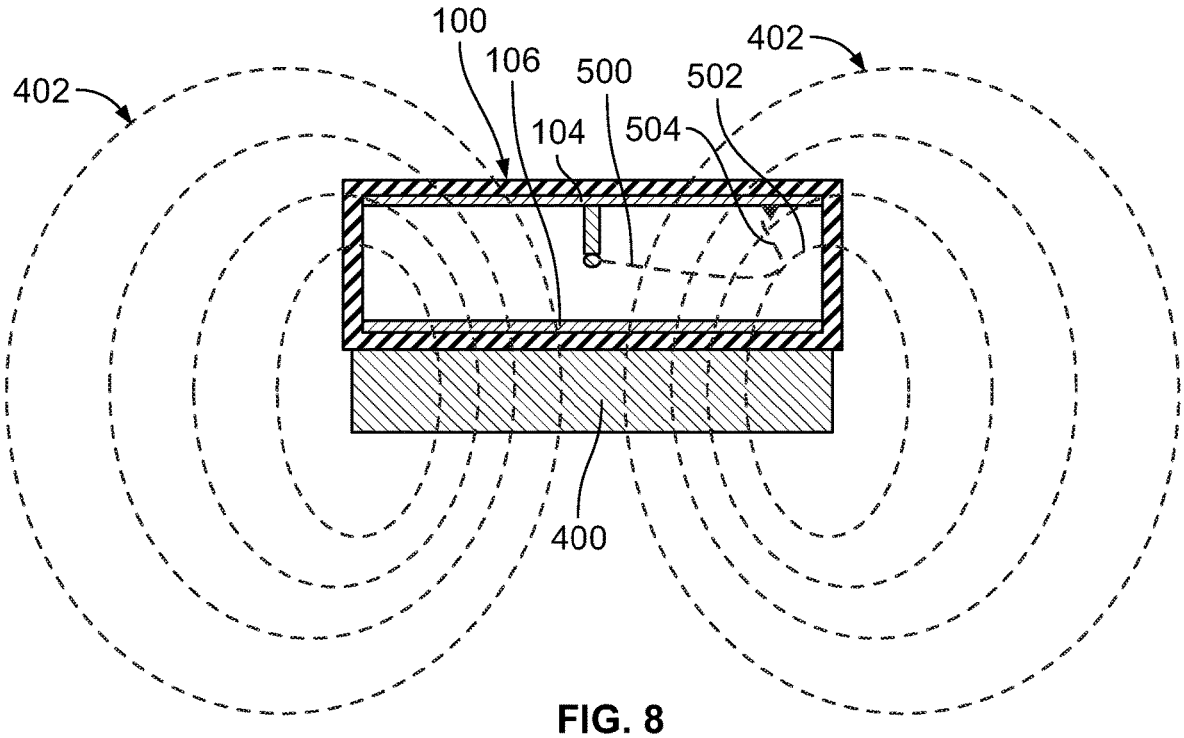
FIG. 8 illustrates a path of an alpha particle travelling at an acute angle relative to a magnetic flux line of a magnetic field, in accordance with an example implementation.

When the alpha particles travel substantially parallel or at an acute angle to a magnetic flux line, the alpha particles may be deflected toward one of the electrodes 104 or 106. FIG. 8 illustrates a path 500 of an alpha particle travelling at an acute angle relative to a magnetic flux line 502 of the magnetic field 402, in accordance with an example implementation. As depicted in FIG. 8, when the radioactive source 102 is positioned at or substantially at a center of the ionization chamber 100, at least some of the alpha particles travel in a path that forms an acute angle with the magnetic flux lines of the magnetic field 402.

For example, as schematically represented in FIG. 8, an alpha particle emitted by the radioactive source 102 can travel along the path 500 and form an acute angle with the magnetic flux line 502. The alpha particle is emitted from the radioactive source 102 at the center of the ionization chamber 100 and is initially headed below a center plane of the ionization chamber 100. The alpha particle then follows a constant pitch angle relative to magnetic flux lines and can spiral along the magnetic flux lines. The alpha particle can thus diverge upward upon reaching the magnetic flux line 502 as shown by portion 504 of the path 500. Particularly, the alpha particle may be deflected upward toward the electrode 104. As such, the alpha particle traverses a small distance before impacting the electrode 104, and therefore is less effective in ionizing air molecules.

On the other hand, if the alpha particles are travelling perpendicular to the magnetic flux lines, the alpha particles may curve laterally parallel to the plane of the electrodes 104, 106 as they travel within the ionization chamber 100 away from the radioactive source 102. This way, the alpha particles travel longer distances and spend more time and energy travelling within the ionization chamber 100 prior to impacting internal surfaces thereof or the electrodes 104, 106, and thus more ions are generated. In an example, to cause the alpha particles to travel in a path that is substantially perpendicular to the magnetic flux lines of the magnetic field 402, it may be desirable to place the radioactive source 102 close to or mounted to the electrode that is opposite the magnet 400 (e.g., the electrode 104), rather than at the center of the ionization chamber 100.

Figure 9:
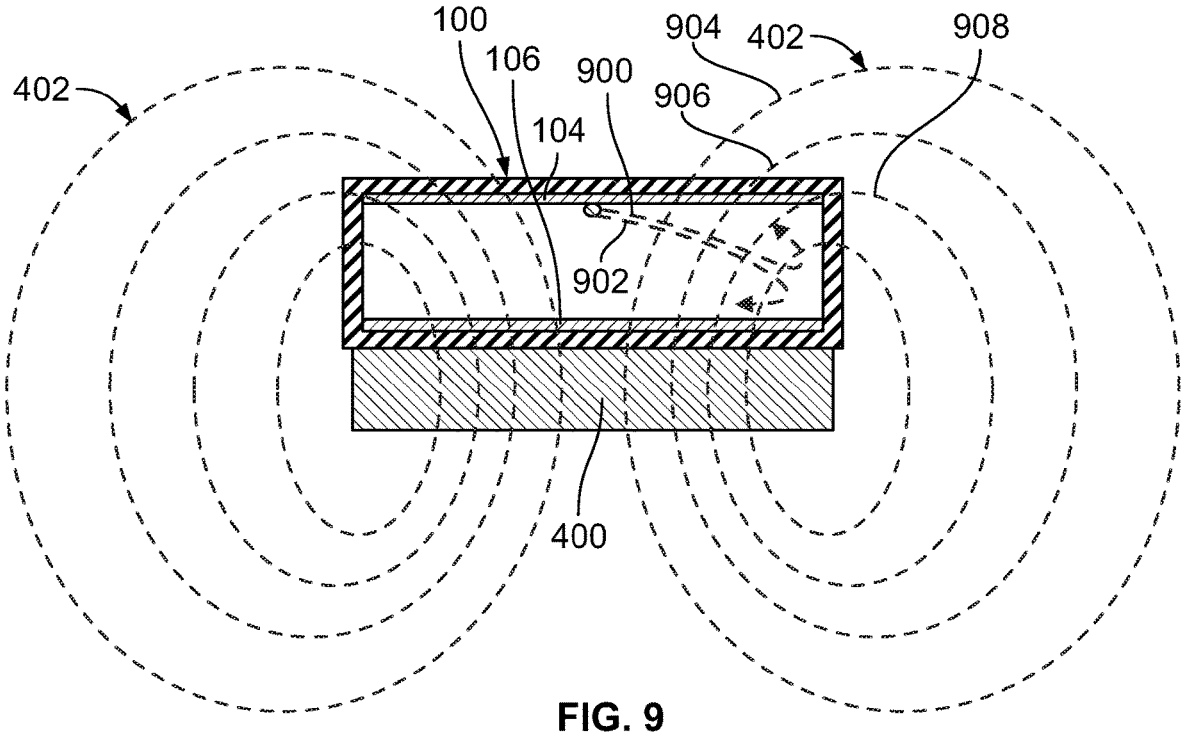
FIG. 9 illustrates a radioactive source mounted to an electrode disposed opposite a magnet, in accordance with an example implementation.

FIG. 9 illustrates the radioactive source 102 mounted to the electrode 104 disposed opposite the magnet 400, in accordance with an example implementation. As shown in FIG. 9, the pole 109 is removed and the radioactive source 102 is mounted to the electrode 104, which is disposed opposite the magnet 400. Thus, the ionization chamber 100 has a first base or side at which the first electrode 104 and the radioactive source 102 are disposed and a second base or side at which the second electrode 106 is disposed. The magnet 400 is mounted to the exterior surface of the ionization chamber 100 adjacent to the second electrode 106 (on the other side of a wall of the ionization chamber 100 from the second electrode 106), opposite the first electrode 104.

As a result of the configuration of FIG. 9, the radioactive source 102 is farther from the magnet 400 compared to the implementation of FIG. 4. This way, due to the oval shape of the magnetic flux lines of the magnetic field 402, the alpha particles emitted by the radioactive source 102 travel in paths that are substantially perpendicular to the magnetic flux lines. The term "substantially" is used herein to indicate that the path of the alpha particle forms an angle with one or more magnetic flux lines that is less than a predetermined threshold angle, such as 15 degrees.

As an example for illustration, a first alpha particle can travel along a path 900 and a second alpha particle can travel along a path 902. As shown in FIG. 9, the paths 900, 902 are substantially perpendicular to magnetic flux lines, such as magnetic flux line 904, magnetic flux line 906, and magnetic flux line 908 of the magnetic field 402. By being substantially perpendicular to the magnetic flux lines, and more particularly, to the magnetic flux lines closer to a periphery of the ionization chamber 100 (such as the magnetic flux line 908), the alpha particles may follow flat spiral paths such as the paths 900, 902 and spend more time and energy within the ionization chamber 100. As a result, more ions may be generated per unit mass of material of the radioactive source 102. Thus, efficiency of the smoke detector can be increased and less radioactive material can be used for the radioactive source 102.

In other example implementations, rather than removing the pole 109 and mounting the radioactive source 102 to the electrode 104 as shown in FIG. 9, a shorter pole can be used. This way, the radioactive source 102 can be offset from the center of the ionization chamber 100 toward the electrode 104, such that the radioactive source 102 is proximate to (e.g., within a threshold distance of 2-5 mm from) the electrode 104.

Referring back to FIG. 4, in examples, the magnetic field 402 can be more effective when magnetic flux lines of the magnetic field 402 are substantially perpendicular to a plane of the electrodes 104 and 106. In other words, the magnetic field 402 is more effective when magnetic flux lines of the magnetic field 402 are substantially parallel to a longitudinal axis 412 of the ionization chamber 100. The term "substantially" is used herein to indicate that a flux line may form an angle with the longitudinal axis 412 that is less than a predetermined threshold angle, such as 30 degrees.

The longitudinal axis 412 is a reference axis used herein to indicate an axis that is perpendicular to a plane of the electrodes 104, 106. For example, if the ionization chamber 100 is cylindrical and the electrodes 104, 106 are disposed at the respective bases of the ionization chamber 100, the longitudinal axis 412 is perpendicular to the bases of the ionization chamber 100. As another example, if the ionization chamber 100 is rectangular and the electrodes 104, 106 are disposed at opposing sides of the ionization chamber 100, the longitudinal axis 412 is perpendicular to the opposing sides at which the electrodes 104, 106 are disposed.

To render at least a portion of the magnetic flux lines substantially parallel to the longitudinal axis 412, the magnet 400 may be oriented as shown in FIG. 4 with the top side being magnetized as a north pole "N," and the bottom side being magnetized as a south pole "S." However, in other examples, the polarity could be reversed, with the top side being magnetized as a south pole "S," and the bottom side being magnetized as a north pole "N."

As mentioned above, the angle that a magnetic flux line of the magnetic field 402 makes with the longitudinal axis 412 is non-uniform or inconsistent due its oval shape. For example, a magnetic flux line 414 is oval-shaped, and therefore forms a smaller angle relative to the longitudinal axis 412 close to the electrode 106 of the ionization chamber 100. However, the angle of the magnetic flux line 414 relative to the longitudinal axis 412 increases where the magnetic flux line 414 is close to the interior peripheral side surface 114 of the ionization chamber 100.

If the magnetic flux line 414 is substantially parallel to the longitudinal axis 412, the magnetic flux line 414 causes the alpha particle to curve laterally parallel to the plane of the electrodes 104 and 106 while it travels within the ionization chamber 100 away from the radioactive source 102. However, as the angle between the magnetic flux line 414 and the longitudinal axis 412 increases, e.g., the magnetic field 402 can cause the alpha particle to curve or deflect toward one of the electrodes 104 or 106. An alpha particle deflected toward the electrode 104 or 106 traverses a smaller distance before hitting the electrode, and therefore is less effective in ionizing air molecules. In an example, to render the magnetic flux lines of the magnetic field 402 more uniformly substantially parallel to the longitudinal axis 412, a second magnet can be used.

Figure 10:
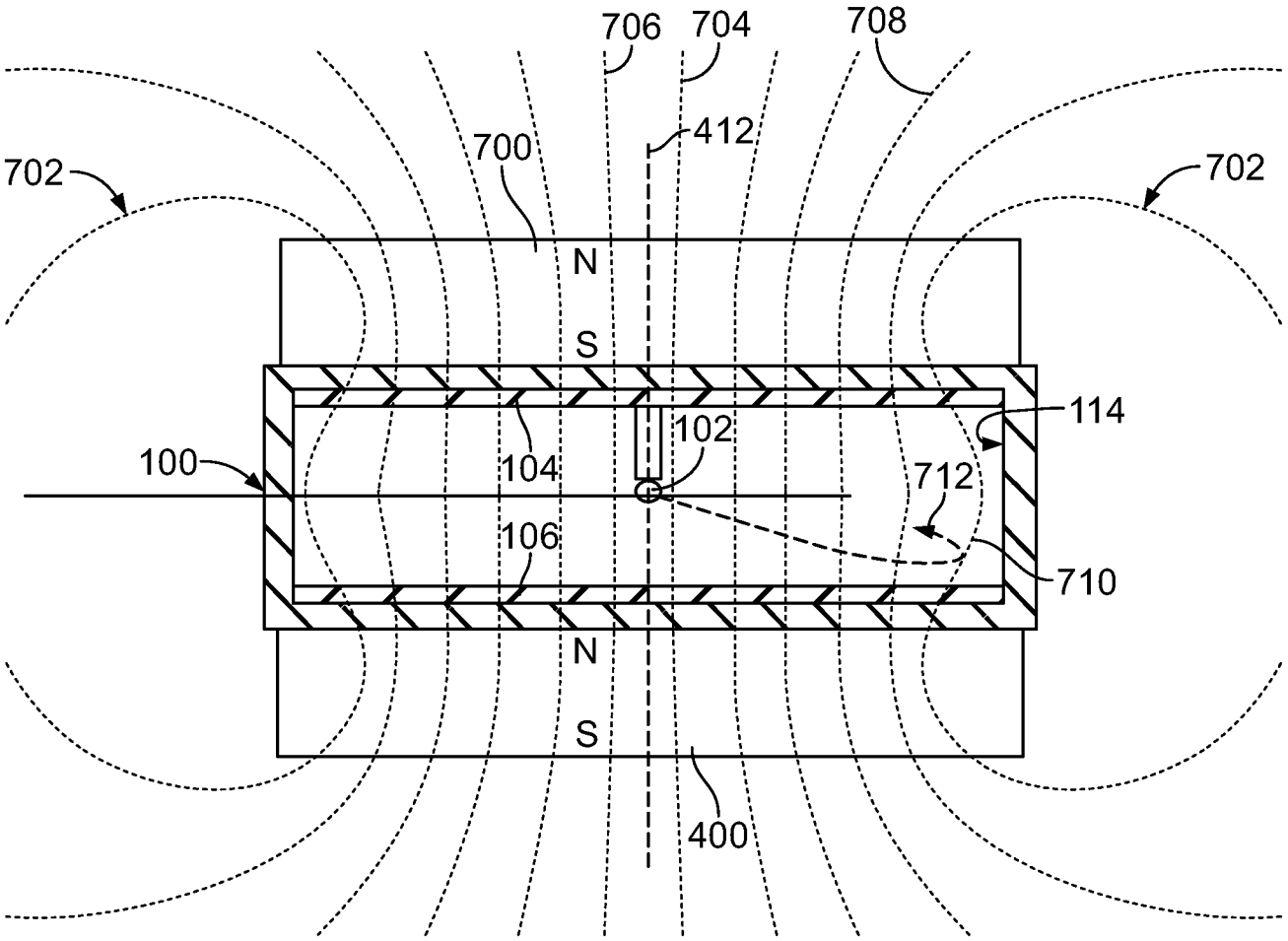
FIG. 10 illustrates two magnets coupled to an ionization chamber, in accordance with an example implementation.

FIG. 10 illustrates two magnets coupled to the ionization chamber 100, in accordance with an example implementation. As shown, in addition to the magnet 400, a second magnet 700 is coupled to the ionization chamber 100. In examples, the magnet 700 is coupled to an exterior surface of the ionization chamber 100 on an opposite side thereof relative to the magnet 400. For instance, the magnet 700 can be coupled to a side of the ionization chamber 100 that is adjacent to the electrode 104. The magnet 700 can be disposed parallel to the electrodes 104, 106 and the magnet 400.

In other examples, the magnet 700 can be mounted within the ionization chamber 100 similar to magnet 400 as depicted in the configuration shown in FIG. 7. In some examples, the magnet 700 might not be parallel to the electrodes 104, 106, or the magnet 400. The magnet 700 is disposed within the smoke detector 101, which is not shown in FIG. 10 to reduce visual clutter in the drawing.

In examples, the magnet 700 can be polarized as shown in FIG. 10 similar to the magnet 400. For example, if the top side of the magnet 400 is magnetized as a north pole "N" and its bottom side is magnetized as a south pole "S," then the top side of the magnet 700 can also be magnetized as a north pole "N" and its bottom side is magnetized as a south pole "S." Alternatively, if the bottom side of the magnet 400 is magnetized as a north pole "N" and its top side is magnetized as a south pole "S," then the bottom side of the magnet 700 can also be magnetized as a north pole "N" and its top side is magnetized as a south pole "S." With this configuration, the magnetic field 402 generated by the magnet 400 is reinforced by the respective magnetic field generated by the magnet 700.

The magnets 400, 700 cooperate to generate a magnetic field 702 having magnetic flux lines passing through the air within the ionization chamber 100. With the configuration of FIG. 10, alignment or degree of parallelism of magnetic flux lines of the magnetic field 702 relative to the longitudinal axis 412 of the ionization chamber 100 is enhanced compared to the configuration of FIG. 4, where one magnet is used.

For example, magnetic flux line 704 and magnetic flux line 706 are substantially parallel to the longitudinal axis 412, e.g., the magnetic flux lines 704, 706 may form an angle with the longitudinal axis 412 that is less than a predetermined threshold angle, such as 5 degrees. Even peripheral magnetic flux lines located away from the longitudinal axis 412 and closer to a periphery of the ionization chamber 100, such as magnetic flux line 708, are substantially parallel to the longitudinal axis 412, particularly a portion thereof that passes through the air within the ionization chamber 100. As such, the configuration of FIG. 10 may be more effective in ionizing air molecules within the ionization chamber 100.

Further, magnetic flux lines that are located close to the periphery or rim of the ionization chamber 100, such as magnetic flux line 710, have concave portions near the interior peripheral side surface 114 as shown in FIG. 10. These concave portions can help deflect alpha particles away from both electrodes 104 and 106. Such deflection is shown schematically by curved path 712 in FIG. 10 indicating that the alpha particle reaching a curved portion of the magnetic flux line 710 deflects away from the electrode 106 back toward the inner space of the ionization chamber 100. This way, the alpha particle spends more of its life-time within the ionization chamber 100 ionizing air molecules and enhancing the efficiency of the smoke detector 101.

In examples, the magnets 400, 700 can be permanent magnets. For instance, the magnets 400, 700 may include samarium-cobalt magnets, which is a type of rare-earth permanent magnets made of an alloy of samarium and cobalt. Alternatively, the magnets 400, 700 can include neodymium magnets (also known as NdFeB, NIB, or Neo magnet), which is a type of rare-earth permanent magnets made from an alloy of neodymium, iron and boron. Other types of permanent magnets can be used.

In another example, the magnets 400, 700 can be electromagnets, where the magnetic field 402 or 702 is produced by an electric current. In this example, the magnets 400, 700 can include an insulated wire wound into a coil. A current through the wire creates a magnetic field, which is concentrated in the hole at the center of the coil. The wire may be wound around a magnetic core made from a ferromagnetic or ferrimagnetic material such as iron to concentrate the magnetic flux.

In another example, the magnets 400, 700 can be electro-permanent magnets (EPMs). An EPM is a type of magnet that includes both an electromagnet and a dual material permanent magnet. A magnetic field produced by the electro-magnet is used to change the magnetization of the permanent magnet. In an example, the permanent magnet includes magnetically soft and hard materials, where the soft material has lower magnetic coercivity compared to the hard material and can thus have its magnetization changed. When the magnetically soft and hard materials have opposite magnetizations, the EPM has no net magnetic field, and when they are aligned, the EPM generates an external magnetic field.

In examples, the magnets 400, 700 can be made of the same type of magnets. In other examples, the magnet 400 can be made of a different magnet type than the magnet 700.

As mentioned above with respect to FIG. 7, magnets are electrically-conductive. As such, magnets can also operate as electrodes that can be coupled to a voltage source and voltages can be applied thereto to generate a potential difference. Thus, in some example implementations, the magnets 400, 700 can be placed within the ionization chamber to introduce a magnetic field within the ionization chamber 100, while also operating as electrodes, thereby replacing the electrodes 104, 106. With such configuration, the electrodes 104, 106 can be eliminated to reduce cost.

When two magnets are used such as in the configuration of FIG. 10, it may be desirable to place the radioactive source 102 at or substantially at the center of the ionization chamber 100, rather than closer to either electrode 104, 106. This way, alpha particles emitted from the radioactive source 102 follow paths that are substantially perpendicular to the magnetic flux lines.

Alpha particles have a higher speed when they are first emitted from, or when they are closer to, the radioactive source 102 compared to their speed as they get farther from the radioactive source 102 and are slowed down by air in the ionization chamber 100. When the alpha particles have a high speed (closer to the radioactive source 102 proximate and middle portion of the ionization chamber 100), the magnetic field 702 can be less effective in causing the alpha particles to curve. As the alpha particles move farther away from the middle portion of the ionization chamber 100 toward peripheral portions thereof, the magnetic field 702 can be more effective in causing the alpha particles to curve and ionize more air molecules.

As such, one way to reduce cost of the magnets while maintaining their effectiveness is to configure the magnets to have more magnetic material at a periphery of the ionization chamber 100 compared to middle sections thereof. In other words, rather than using uniform-thickness magnets (such as the magnets 400, 700) generating uniform magnetic fields, magnets that are ring-shaped or magnets that are thinner in the middle compared to their periphery can be used. This way, strength of the magnetic field generated by the magnets is stronger closer to the periphery of the ionization chamber 100 where it is most effective in curving the alpha particles.

Figure 11:
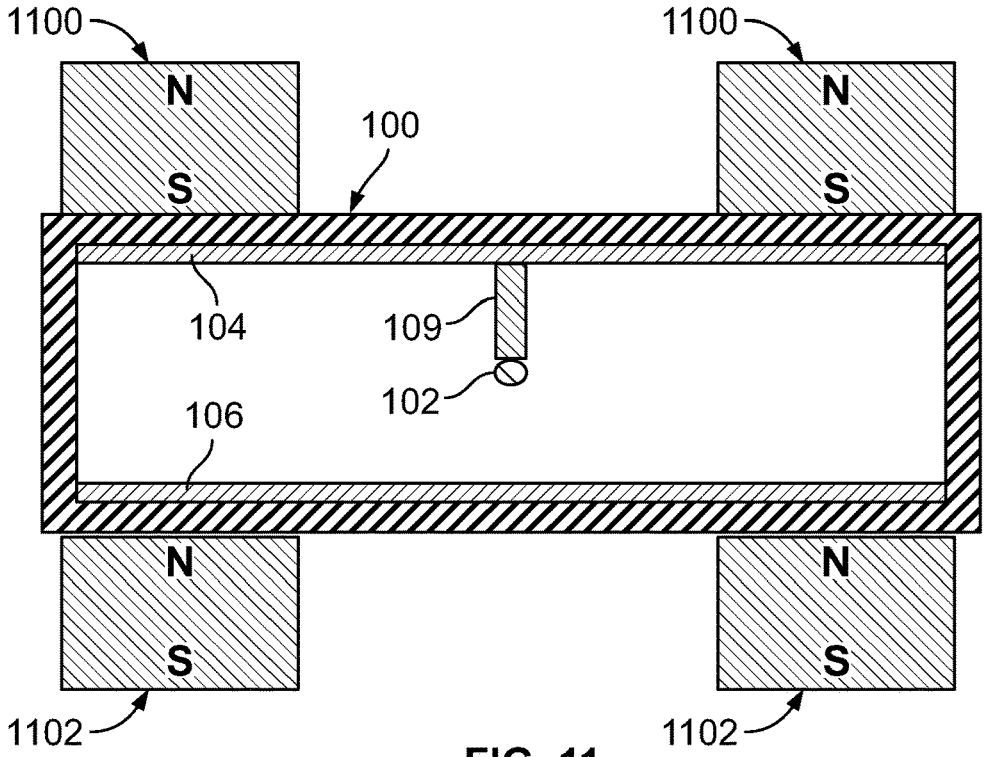
FIG. 11 illustrates a partial cross-sectional view of a smoke detector having magnets that are ring-shaped, in accordance with an example implementation.
Figure 12:
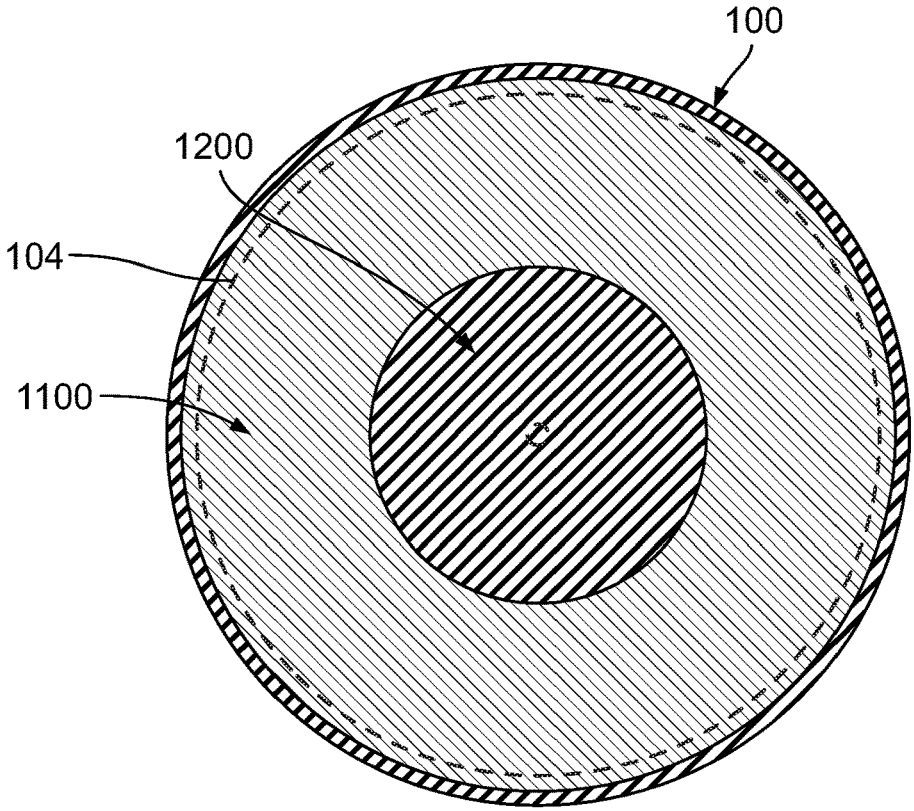
FIG. 12 illustrates a partial top view of the smoke detector shown in FIG. 11, in accordance with an example implementation.

FIG. 11 illustrates a partial cross-sectional view of a smoke detector having magnets 1100, 1102 that are ring-shaped, and FIG. 12 illustrates a partial top view of the smoke detector shown in FIG. 11, in accordance with an example implementation. As depicted in FIG. 11, the magnets 1100, 1102 are ring-shaped or doughnut-shaped such that they are hollow at the middle and have respective rims disposed at a peripheral portion of the ionization chamber 100. FIG. 12 shows a doughnut hole 1200 in the middle of the magnet 1100. The magnet 1102 can be configured similar to the magnet 1100. This way, strength, and majority of the magnetic flux lines, of a magnetic field generated by the magnets 1100, 1102 are focused closer to a periphery or peripheral portions of the ionization chamber 100 where the magnetic field is more effective in curving the alpha particles.

Figure 13:
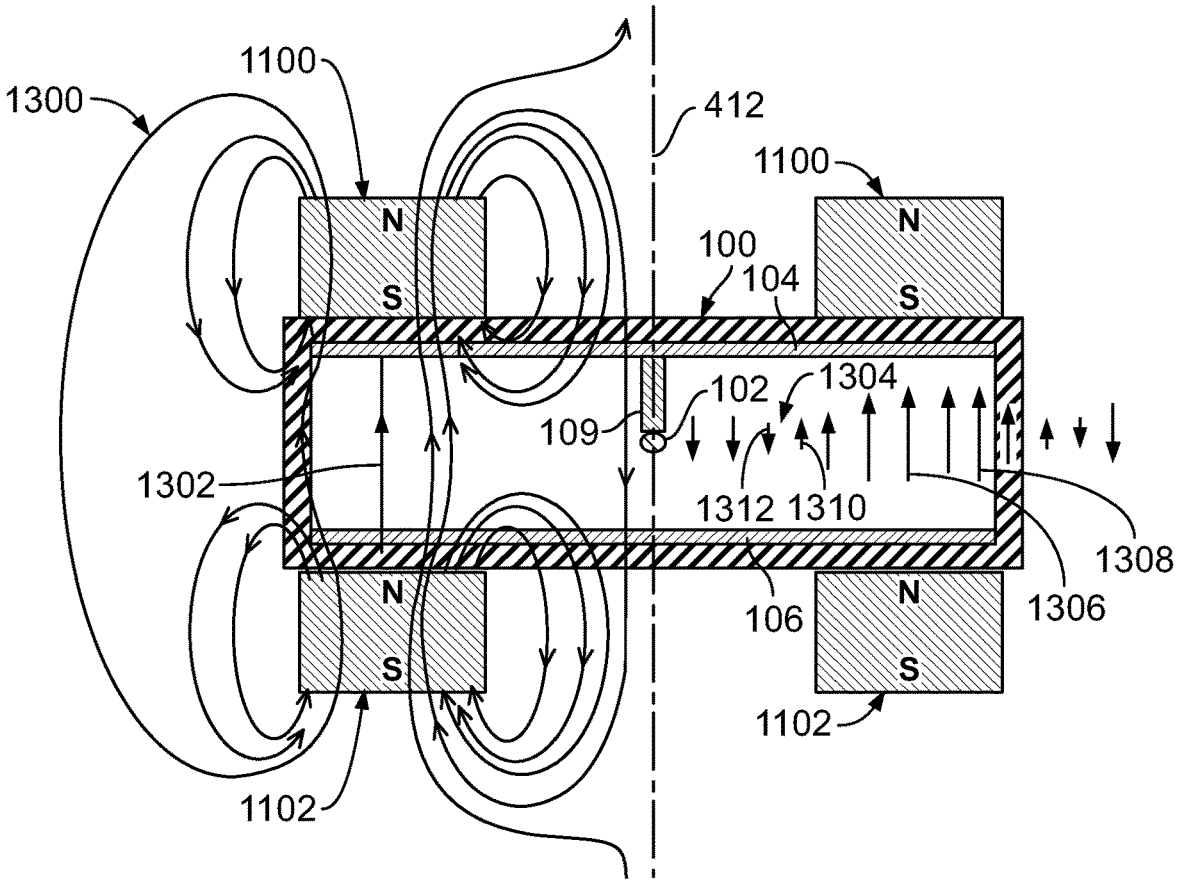
FIG. 13 illustrates a top view of the smoke detector shown in FIG. 11, in accordance with an example implementation.

FIG. 13 illustrates schematic representation of a magnetic field 1300 generated by the magnets 1100, 1102, in accordance with an example implementation. The magnets 1100, 1102 can be configured to have parallel polarity as indicated by the "N" and "S" designations in FIG. 13. With such configuration, magnetic flux lines, such as magnetic flux line 1302, are substantially perpendicular to the electrodes 104, 106 and substantially parallel to the longitudinal axis 412 of the ionization chamber 100. As a result, the magnetic field 1300 can be effective in curving the alpha particles as they reach peripheral portions of the ionization chamber 100.

FIG. 13 further depicts a magnetic field vector 1304 schematically to illustrate variation of strength of the magnetic field and direction of the magnetic flux lines generated by the magnets 1100, 1102. Each vector in the magnetic field vector 1304 is represented as an arrow having an arrow head that represents its direction, and a particular length that represents strength of the magnetic field thereat compared to other field vectors.

For example, magnetic field vectors 1306, 1308 at the peripheral portions of the ionization chamber 100 are longer than magnetic field vectors 1310, 1312 at the middle portion of the ionization chamber 100 to indicate that the magnetic field 1300 is stronger closer to the peripheral portions of the ionization chamber 100 where it is most effective as the alpha particles slow down. Because the magnets 1100, 1102 are hollow, less magnetic material is used, and thus cost of the magnets 1100, 1102 can be reduced. As such, most of the benefit of using magnets to curve the alpha particles might be retained while reducing cost of the magnets.

In other examples implementations, rather than using a ring-shaped magnet, a variable thickness magnet having a thinner section in the middle and thicker sections at the periphery or rim of the magnet can be used. This way, cost of the magnet can be reduced by removing material from its middle section, while focusing the strength of the magnetic field at the periphery of the ionization chamber 100 where it is most effective as the alpha particles are slowed down.

Figure 14:
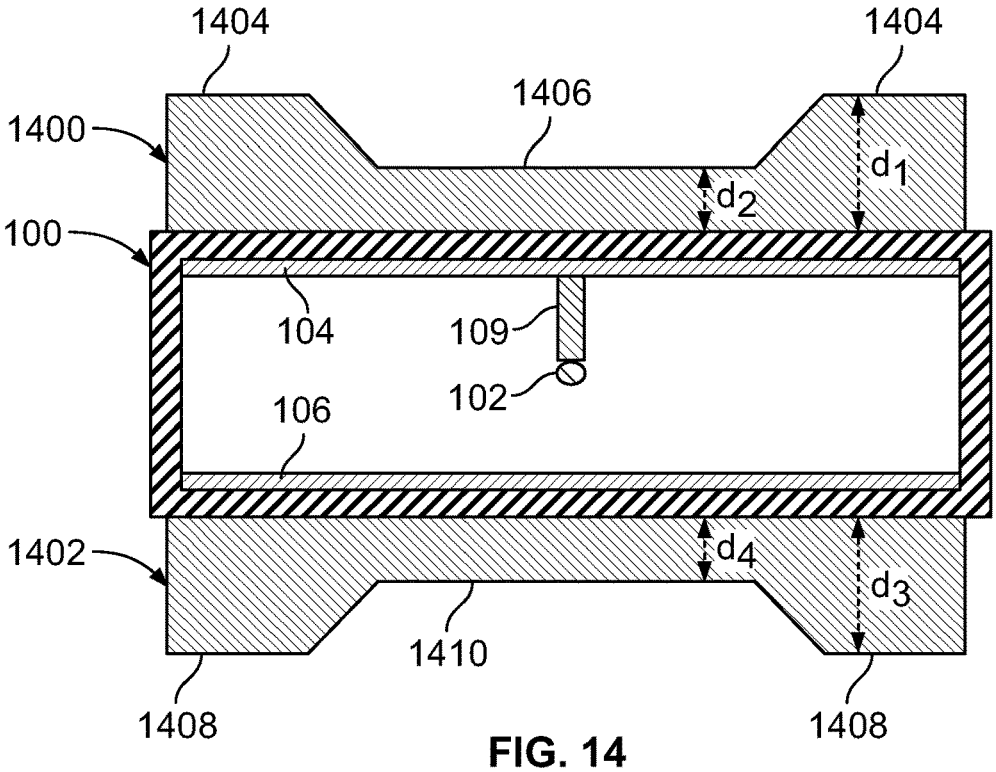
FIG. 14 illustrates a partial cross-sectional view of a smoke detector with magnets having variable thicknesses, in accordance with an example implementation.

FIG. 14 illustrates a partial cross-sectional view of a smoke detector with magnets 1400, 1402 having variable thicknesses, in accordance with an example implementation. Rather than having a uniform thickness like the magnets 400, 700 or being ring-shaped like the magnets 1100, 1102, the magnet 1400 is configured as a variable-thickness magnet. Particularly, the magnet 1400 can be disk-shaped and can have a peripheral portion or a rim 1404 having a first thickness "$d_1$" and a middle thinner portion 1406 having a second thickness "$d_2$" that is less than the first thickness "$d_1$." Similarly, the magnet 1402 can be disk-shaped and can have a peripheral portion or a rim 1408 having a third thickness "$d_3$" and a middle thinner portion 1410 having a fourth thickness "$d_4$" that is less than the third thickness "$d_3$." In examples, the magnets 1400, 1402 can be similar such that $d_1$ is equal to $d_3$ and $d_2$ is equal to $d_4$; however, in other examples, the thicknesses of the magnets 1400, 1402 can be different from each other.

With the configuration in FIG. 14, strength of a magnetic field generated by the magnets 1400, 1402 is increased and focused closer to the rims 1404, 1408 at a periphery of the ionization chamber 100 where the magnetic field is more effective in curving the alpha particles. The middle thinner portions 1406, 1410 have less magnetic material and the magnetic field can thus be weaker at the middle section of the ionization chamber 100 where the magnetic field is less effective in curving the alpha particles. As such, using ring-shaped or variable thickness magnets can reduce cost of smoke detectors by using less magnetic material while achieving at least a large portion of the benefit of having a magnet in the smoke detector.

In other example configurations that can reduce cost of the smoke detector, rather than using two magnets, a single magnet (e.g., any one of the magnets 400, 700, 1100, or 1102) can be used along with a member made of a ferromagnetic or ferrimagnetic material such as iron to concentrate the magnetic flux in the ionization chamber 100.

Figure 15:
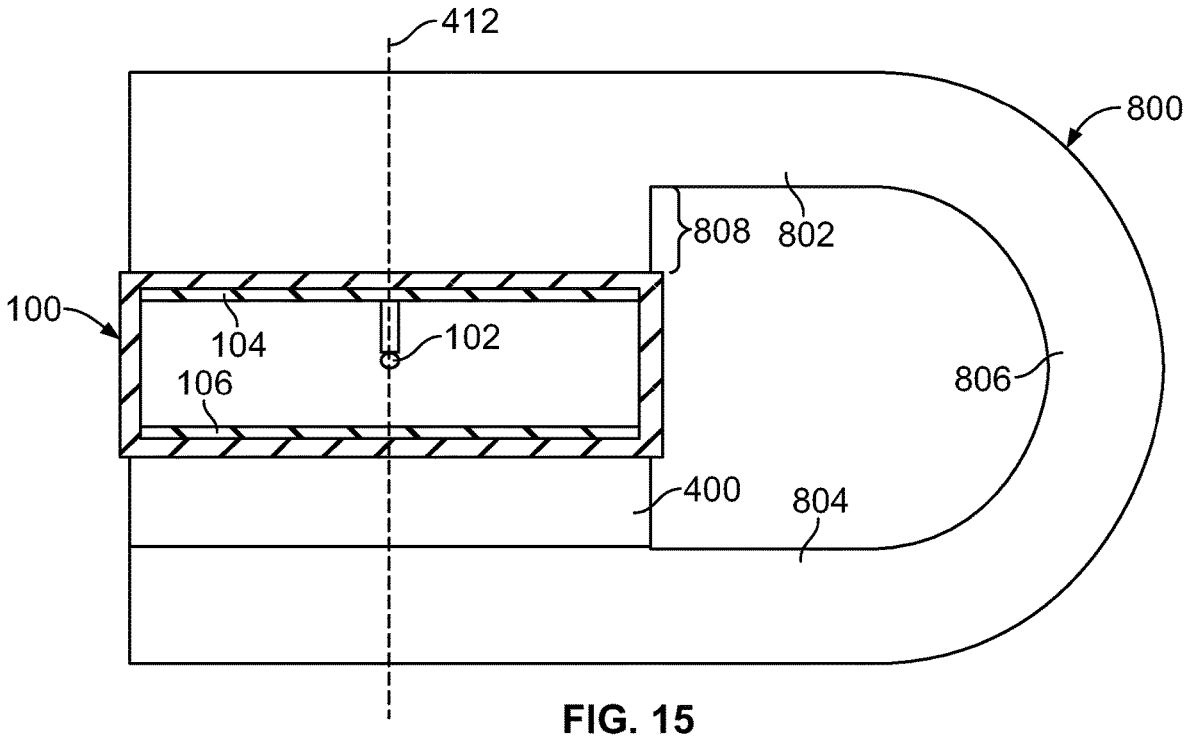
FIG. 15 illustrates using a single magnet with a yoke to enhance a magnetic field generated within an ionization chamber, in accordance with an example implementation.

FIG. 15 illustrates using the magnet 400 with a yoke 800 to enhance a magnetic field generated within the ionization chamber 100, in accordance with an example implementation. In an example, the yoke 800 is generally U-shaped and has two generally parallel and laterally disposed leg portions 802 and 804 and a connecting portion 806 that couples or connects the leg portions 802 and 804 to each other.

As shown in FIG. 15, the leg portion 804 interfaces, directly or indirectly, with the magnet 400. In examples, the leg portion 804 can be pressed against the magnet 400. In other examples, the leg portion 804 can comprise the magnet 400. The magnetic field generated by the magnet 400 is carried or transmitted via the leg portion 804, through the connecting portion 806 and the leg portion 802, to the other side of the ionization chamber 100 adjacent to the electrode 104.

The yoke 800 can be made of high-permeability ferromagnetic or ferrimagnetic material that reduces magnetic reluctance, thus increasing strength of and concentrating the magnetic flux generated by the magnet 400. The yoke 800 further operates as a channel that transfers the magnetic field to the other side of the ionization chamber 100, thereby operating as a second magnet disposed on the other side of the ionization chamber 100 adjacent to the electrode 104. Thus, the yoke 800 may be used in lieu of the magnet 700, and cost may thus be reduced.

Further, the yoke 800, and specifically the leg portion 802, may include a protrusion 808 shaped similar to the magnet 700. As such, the yoke 800 can be considered as comprising the magnet 700. The protrusion 808 may enhance alignment or degree of parallelism of the magnetic flux lines within the ionization chamber 100 relative to the longitudinal axis 412.

Although FIG. 15 illustrates using the yoke 800 with the magnet 400, the yoke 800 can be configured to be used with the magnet 700 disposed adjacent to the electrode 104. In another example, the yoke 800 could be used with the configuration of FIG. 10 with the two magnets 400, 700 to further enhance the magnetic field.

Although FIG. 15 illustrates using the yoke 800 with the magnet 400, which has a uniform thickness, the yoke 800 can be used with the magnet 1102 that is ring-shaped or the magnet 1402 that has variable thickness. Further, the leg portion 802, and particularly, the protrusion 808, can be formed as a ring or can have variable thickness to simulate or operate similar to the magnet 1100 or the magnet 1400. In examples, two magnets can be used (e.g., the magnets 400, 700; the magnets 1100, 1102; or the magnets 1400, 1402) and the yoke 800 may include only the connecting portion 806 to couple the two magnets to each other. Further, the yoke 800 can be referred to as a coupling member and can assume other geometrical shapes than a U-shaped yoke, e.g., a cylindrical or other shape.

The detailed description above describes various features and operations of the disclosed systems with reference to the accompanying figures. The illustrative implementations described herein are not meant to be limiting. Certain aspects of the disclosed systems can be arranged and combined in a wide variety of different configurations, all of which are contemplated herein.

Further, unless context suggests otherwise, the features illustrated in each of the figures may be used in combination with one another. For example, the features of FIGS. 7 and 11 can be combined, where a single ring-shaped magnet or variable-thickness magnet can be used in lieu of the magnet 400 in FIG. 7. In such an example, the radioactive source 102 can be mounted to the opposite electrode. In another example, two ring-shaped or variable thickness magnets can be mounted within the ionization chamber 100. Thus, the figures should be generally viewed as component aspects of one or more overall implementations, with the understanding that not all illustrated features are necessary for each implementation, and that features in different figures or implementations can be combined.

Additionally, any enumeration of elements, blocks, or steps in this specification or the claims is for purposes of clarity. Thus, such enumeration should not be interpreted to require or imply that these elements, blocks, or steps adhere to a particular arrangement or are carried out in a particular order.

Further, devices or systems may be used or configured to perform functions presented in the figures. In some instances, components of the devices and/or systems may be configured to perform the functions such that the components are actually configured and structured (with hardware and/or software) to enable such performance. In other examples, components of the devices and/or systems may be arranged to be adapted to, capable of, or suited for performing the functions, such as when operated in a specific manner.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide The arrangements described herein are for purposes of example only. As such, those skilled in the art will appreciate that other arrangements and other elements (e.g., machines, interfaces, operations, orders, and groupings of operations, etc.) can be used instead, and some elements may be omitted altogether according to the desired results. Further, many of the elements that are described are functional entities that may be implemented as discrete or distributed components or in conjunction with other components, in any suitable combination and location.

While various aspects and implementations have been disclosed herein, other aspects and implementations will be apparent to those skilled in the art. The various aspects and implementations disclosed herein are for purposes of illustration and are not intended to be limiting, with the true scope being indicated by the following claims, along with the full scope of equivalents to which such claims are entitled. Also, the terminology used herein is for the purpose of describing particular implementations only, and is not intended to be limiting.

What is claimed is:

1. A smoke detector comprising:

a chamber;

a first electrode disposed within the chamber;

a magnet disposed within the chamber opposite the first electrode, wherein the magnet is electrically-conductive and is configured as a second electrode, wherein gas is disposed in an inner space of the chamber between the first electrode and the magnet, and wherein the magnet is configured to generate a magnetic field in the inner space of the chamber; and a radioactive source generating alpha particles within the inner space of the chamber.

2. The smoke detector of claim 1, wherein the chamber is shaped as a cylinder, wherein the first electrode is disposed within the cylinder and mounted to a first base thereof, and wherein the magnet is disposed within the cylinder and mounted to a second base thereof opposite the first base.

3. The smoke detector of claim 1, wherein the magnet is coupled to an interior surface of the chamber opposite the first electrode.

4. The smoke detector of claim 1, further comprising:

a pole coupled to the first electrode, wherein the pole protrudes within the inner space of the chamber, wherein the radioactive source is coupled to the pole.

5. The smoke detector of claim 4, wherein the pole is configured to have a length that causes the radioactive source to be offset from a center of the chamber toward the first electrode.

6. The smoke detector of claim 1, wherein the radioactive source is mounted to the first electrode.

7. The smoke detector of claim 1, wherein the first electrode is made of a ferromagnetic material.

8. A smoke detector comprising:

a chamber;

a first electrode disposed within the chamber;

a second electrode disposed within the chamber opposite the first electrode, wherein gas is disposed within the chamber between the first electrode and the second electrode;

a radioactive source mounted to the first electrode, wherein the radioactive source is configured to emit alpha particles in the gas disposed between the first electrode and the second electrode; and a magnet disposed in the smoke detector and coupled to an exterior surface of the chamber adjacent to the second electrode, wherein the magnet generates a magnetic field having magnetic flux lines passing through the gas between the first electrode and the second electrode.

9. The smoke detector of claim 8, wherein the chamber is shaped as a cylinder, wherein the first electrode is disposed within the cylinder and mounted to a first base thereof, and wherein the second electrode is disposed within the cylinder and mounted to a second base thereof opposite the first base.

10. The smoke detector of claim 8, wherein the magnet is ring-shaped such that the magnet is hollow and has a rim disposed at a peripheral portion of the chamber.

11. The smoke detector of claim 8, wherein the magnet has a variable thickness such that a middle portion of the magnet is thinner than a peripheral portion of the magnet.

12. The smoke detector of claim 8, wherein the first electrode and the second electrode are made of a ferromagnetic material.

13. A smoke detector comprising:

a chamber;

a first electrode disposed within the chamber;

a second electrode disposed within the chamber, wherein gas is disposed in an inner space of the chamber between the first electrode and the second electrode;

a radioactive source emitting alpha particles in the gas disposed between the first electrode and the second electrode;

a first magnet that is ring-shaped and mounted to an exterior surface of the chamber at a first side of the chamber; and a second magnet that is ring-shaped and mounted to the exterior surface of the chamber at a second side of the chamber opposite the first side thereof, wherein the first magnet and the second magnet cooperate to generate a magnetic field having magnetic flux lines passing through the gas disposed between the first electrode and the second electrode.

14. The smoke detector of claim 13, wherein the chamber is shaped as a cylinder, wherein the first electrode is disposed within the cylinder and mounted to a first base thereof, and wherein the second electrode is disposed within the cylinder and mounted to a second base thereof opposite the first base.

15. The smoke detector of claim 13, wherein the first electrode is coupled to an interior surface of the chamber at the first side adjacent to the first magnet, and wherein the second electrode is coupled to the interior surface of the chamber at the second side adjacent to the second magnet.

16. The smoke detector of claim 13, further comprising:

a pole coupled to the first electrode or the second electrode, wherein the pole protrudes within the inner space of the chamber, and wherein the radioactive source is coupled to a tip of the pole such that the radioactive source is positioned proximate to a center of the chamber.

17. The smoke detector of claim 13, wherein the first electrode and the second electrode are made of a ferromagnetic material.

18. The smoke detector of claim 13, further comprising:

a coupling member that couples the first magnet to the second magnet.

19. The smoke detector of claim 18, wherein the coupling member includes a yoke having a U-shape and couples the first magnet to the second magnet.

20. The smoke detector of claim 18, wherein the coupling member is made of a ferromagnetic or ferrimagnetic material.

* * * * *